US009316390B2

(12) United States Patent
Gowanlock et al.

(10) Patent No.: US 9,316,390 B2
(45) Date of Patent: Apr. 19, 2016

(54) LIGHTING SYSTEM FOR DRILLING RIG

(71) Applicant: AITHRA PROJECTS INC., Airdrie (CA)

(72) Inventors: Matthew Gowanlock, Airdrie (CA); Darcy K. Dupuis, Calgary (CA)

(73) Assignee: Apollo Energy Services Corp., Calgary (CA)

( * ) Notice: Subject to any disclaimer, the term of this patent is extended or adjusted under 35 U.S.C. 154(b) by 183 days.

(21) Appl. No.: 14/093,097

(22) Filed: Nov. 29, 2013

(65) Prior Publication Data

US 2015/0153036 A1 Jun. 4, 2015

(51) Int. Cl.

| | |
|---|---|
| ***E21B 15/00*** | (2006.01) |
| ***F21V 14/02*** | (2006.01) |
| ***F21V 21/116*** | (2006.01) |
| ***F21V 33/00*** | (2006.01) |
| *F21S 8/08* | (2006.01) |
| *F21W 131/10* | (2006.01) |

(52) U.S. Cl.

CPC ..... *F21V 33/00* (2013.01); *E21B 15/00* (2013.01); *F21S 8/085* (2013.01); *F21V 21/116* (2013.01); *F21W 2131/10* (2013.01)

(58) Field of Classification Search

CPC ... F21S 8/085; F21W 2131/10; F21V 21/116; F21V 21/22; F21V 21/14; F21V 33/00; E21B 15/00; E21B 7/023

USPC ..... 362/431, 418, 419, 427, 249.02, 362/249.09, 414, 249.01, 285, 191; 52/28, 52/118, 123.1

See application file for complete search history.

(56) References Cited

U.S. PATENT DOCUMENTS

| | | | | | |
|---|---|---|---|---|---|
| 3,827,197 | A | * | 8/1974 | Adam | 52/29 |
| 4,450,507 | A | * | 5/1984 | Gordin | 362/463 |
| 5,272,609 | A | * | 12/1993 | Nelson | 362/249.07 |
| 5,432,691 | A | * | 7/1995 | Garrett et al. | 362/233 |
| 5,551,199 | A | * | 9/1996 | Hayes et al. | 52/648.1 |
| 6,607,285 | B2 | | 8/2003 | Citron et al. | |
| 7,988,343 | B2 | | 8/2011 | Palmisano | |
| 2005/0083690 | A1 | * | 4/2005 | Griffin | 362/249 |
| 2008/0266859 | A1 | * | 10/2008 | Palmisano | 362/250 |

FOREIGN PATENT DOCUMENTS

| | | | |
|---|---|---|---|
| CN | 203215413 | U | 9/2013 |
| WO | WO 2012130787 | A2 * | 10/2012 |

* cited by examiner

*Primary Examiner* — Elmito Breval
*Assistant Examiner* — Arman B Fallahkhair
(74) *Attorney, Agent, or Firm* — Greenblum & Bernstein, P.L.C.

(57) ABSTRACT

A lighting system for a drilling rig including a lighting frame attached to a crown of the drilling rig, wherein the lighting frame includes an adjustable frame portion attached to the crown of the drilling rig and a light bearing frame portion supported by the adjustable frame portion. Also provided is at least one light support post attached to the light bearing frame portion for holding a lighting fixture and at least one lighting fixture attached to each light support post.

12 Claims, 7 Drawing Sheets

LIGHTING SYSTEM FOR DRILLING RIG

FIELD OF THE INVENTION

The present invention relates generally to the field of drilling apparatuses, such as oil drilling rig arrangements, and in particular to a lighting system for use in an oil drilling rig.

BACKGROUND OF THE INVENTION

Drilling rigs are used to form wellbores for the purpose of extracting oil, natural gas or other fluids from subsurface deposits. Drilling rigs can also be used for sampling subsurface mineral deposits, testing rock or ground fluid properties and for installing subsurface utilities, instrumentations, tunnels or wells. In implementation, drilling rigs may be mobile equipment transportable by truck, rail, trailers, or similar, rigs may also be semi-permanent and permanent fixtures as in the case for oil drilling of large wells. Marine-based structures are also widely known. Generally, the term drilling rig refers to an arrangement of equipment that is used to penetrate the subsurface of the earth's crust.

A conventional drilling rig 30 is illustrated in FIG. 7, where the drilling rig 30 includes a derrick 14, which provides a support structure for a majority of the equipment used to raise and lower drillstring 25 into and out of a wellbore. The drillstring 25 may be an assembled collection of drillpipe, drill collars, or any other assembled collection of assorted tools and equipment connected together and run into the wellbore to facilitate the drilling of a well. The drillstring 25 may be raised and lowered into an dout of the wellbore by the drawworks 7, which includes a spool powered by a motor or other power source 5. A drill line 12, which may be a thick, stranded metal cable, is run through a travelling block 11. Typically, the crown block 13 remains stationary while travelling block 11 moves vertically with the drillstring 25. The combination of the crown block 13 and the travelling block 11 provides a significant mechanical advantage for lifting the drillstring 25. Further, a swivel 18 may be attached to the travelling block 11 to allow rotation of the drillstring 25 without twisting the travelling block 11

The drilling rig 30 further includes a rotary table 20 mounted in a rig floor 21, which is used to rotate the drillstring 25 along with a kelly drive 19. Kelly drive 19, attached at an upper end to the swivel 18 and at a lower end to the drillstring 25, is inserted through the rotary table 20 to rotate the drillstring 25 (drillstring rotation shown by arrow "R"). Kelly drive 19 may be square, hexagonal, or any other polygonal-shaped tubing and is able to move freely vertically while the rotary table 20 rotates it. Alternatively, drilling rig 30 may include a top drive (not shown) in place of kelly drive 19 and rotary table 20. Additionally, blowout preventers ("BOPs") may be located below the rig floor 21 and installed atop a wellhead 27 to prevent fluids and gases from escaping from the wellbore. An annular BOP 23 and one or more ram BOPs 24 are shown and are commonly understood in the art.

During drilling operations, drilling fluid may be circulated through the system to carry cuttings away from the bottom of the wellbore as drilling progresses. Drilling fluid may be stored in mud tanks 1 before being drawn through suction line 3 by mud pumps 4. Drilling fluid (drilling fluid route is indicated by arrows "F") is then pumped from mud pumps 4 through a hose 6, up a stand pipe 8, through a flexible hose 9, and down into the wellbore. Drilling fluid returning from the wellbore is routed through a flow line 28 to shakers 2, which are used to separate drill cuttings from the drilling fluid before it is pumped back down the wellbore.

Drilling operations typically occur during daylight hours and visibility in and around the drilling rig has historically only been required when manual work is being done, inspection and calibration, for example. There is a desire to increase productivity by providing visibility during hours of low daylight, and this has thus far been accomplished by providing mobile lighting arrangements on vehicles proximate the drilling rig, or otherwise manually adding impromptu lighting arrangements.

These arrangements are inadequate and not readily adaptable to systematic visibility improvements in appropriate locations around a drilling rig.

SUMMARY OF THE INVENTION

It is an object of the invention to improve upon one or more of the aforementioned deficiencies with the prior art. Accordingly, in one embodiment of the invention, there is provided a lighting system for a drilling rig including a lighting frame attached to a crown of the drilling rig, wherein the lighting frame includes an adjustable frame portion attached to the crown of the drilling rig and a light bearing frame portion supported by the adjustable frame portion; at least one light support post attached to the light bearing frame portion for holding a lighting fixture; and, at least one lighting fixture attached to each the light support post.

According to an aspect of this first embodiment, the adjustable frame portion includes at least four support posts for rigidly fixing the adjustable frame portion to the crown, and further includes, between at least two adjacent support posts, a first tubular load bearing member connected to one of the adjacent support posts; a second tubular load bearing member connected to the other of the adjacent support posts; an extendable frame member extending between and into each of the first and second tubular members; and means for fixing each of the first and second tubular members with respect to the extendable frame member; such that the first and second tubular load bearing members are moveable with respect to the extendable frame member to thereby adjust a distance between adjacent support posts.

According to another aspect of this first embodiment, the means for fixing comprises a pin extending through the respective tubular load bearing member and the extendable frame member.

According to another aspect of this first embodiment, the at least two adjacent support posts comprises all of the at least four support posts; wherein the at least four support posts are arranged to form a generally rectangular shape.

According to another aspect of this first embodiment, the light bearing frame portion comprises an outer structural frame consisting of a plurality of connected beams forming a perimeter around which the at least one light fixture is attached.

According to another aspect of this first embodiment, the light bearing frame portion further includes at least two cross-braces connecting a first side of the outer structural frame to a second side of the outer structural frame; the first and second sides being generally parallel to each other; at least one support brace connecting the at least two cross-braces to each other; and a locating brace connecting one of the at least one support brace to a third side of the outer structural frame; the third side being generally perpendicular to the first and second sizes.

According to another aspect of this first embodiment, there is provided a second locating brace connecting a second of the at least one support brace to a fourth size of the outer structural frame; the fourth side being generally perpendicular to the first and second sizes.

According to another aspect of this first embodiment, at least one of the extendable frame members comprise a recess at a midpoint thereof sized and otherwise dimensioned to receive a main body portion of the locating brace, such that the recess restricts movement of the locating brace in a direction parallel to the extendable frame member.

According to another aspect of this first embodiment, at the at least of the extendable frame members comprises two of the extendable frame members positioned parallel to each other.

According to another aspect of this first embodiment, the light bearing portion further comprises a plurality of light holding platforms spaced around a perimeter of the outer structural frame; the light holding platforms each comprising a first portion for attaching to the outer structural frame and a second portion for holding the light support posts.

According to another aspect of this first embodiment, each of the light support posts are adapted to hold at least two light fixtures.

According to another aspect of this first embodiment, the at least two light fixtures are spaced vertically from each other.

According to another aspect of this first embodiment, the corner support posts are rigidly affixed to the crown by a bracket positioned proximate a bottom end of each the corner support posts; the bracket being attachable to a body of the crown, proximate a base of the crown.

According to a second embodiment of the invention, there is provided a frame for holding at least one light fixture in a drilling rig arrangement; the frame including an adjustable frame portion, a light bearing frame portion supported by the adjustable frame portion, at least one light support post attached to the light bearing frame portion for holding a lighting fixture, and at least one lighting fixture attached to each the light support post.

According to one aspect of this second embodiment, the adjustable frame portion includes at least four support posts for rigidly fixing the adjustable frame portion to the crown, and further includes, between at least two adjacent support posts: a first tubular load bearing member connected to one of the adjacent support posts; a second tubular load bearing member connected to the other of the adjacent support posts; an extendable frame member extending between and into each of the first and second tubular members; and means for fixing each of the first and second tubular members with respect to the extendable frame member; such that the first and second tubular load bearing members are moveable with respect to the extendable frame member to thereby adjust a distance between adjacent support posts.

According to another aspect of this second embodiment, the means for fixing comprises a pin extending through the respective tubular load bearing member and the extendable frame member.

According to another aspect of this second embodiment, the at least two adjacent support posts comprises all of the at least four support posts; wherein the at least four support posts are arranged to form a generally rectangular shape.

According to another aspect of this second embodiment, the light bearing frame portion comprises an outer structural frame consisting of a plurality of connected beams forming a perimeter around which the at least one light fixture is attached.

According to another aspect of this second embodiment, the light bearing frame portion further includes at least two cross-braces connecting a first side of the outer structural frame to a second side of the outer structural frame; the first and second sides being generally parallel to each other; at least one support brace connecting the at least two cross-braces to each other; and, a locating brace connecting one of the at least one support brace to a third side of the outer structural frame; the third side being generally perpendicular to the first and second sizes.

According to another aspect of this second embodiment, there is further provided a second locating brace connecting a second of the at least one support brace to a fourth size of the outer structural frame; the fourth side being generally perpendicular to the first and second sizes.

According to another aspect of this second embodiment, at least one of the extendable frame members comprise a recess at a midpoint thereof sized and otherwise dimensioned to receive a main body portion of the locating brace, such that the recess restricts movement of the locating brace in a direction parallel to the extendable frame member.

According to another aspect of this second embodiment, at the at least of the extendable frame members comprises two of the extendable frame members positioned parallel to each other.

According to another aspect of this second embodiment, the light bearing portion further comprises a plurality of light holding platforms spaced around a perimeter of the outer structural frame; said light holding platforms each comprising a first portion for attaching to said outer structural frame and a second portion for holding said light support posts.

BRIEF DESCRIPTION OF THE DRAWINGS

Embodiments will now be described, by way of example only, with reference to the attached Figures, wherein.

DETAILED DESCRIPTION

Figure 7:
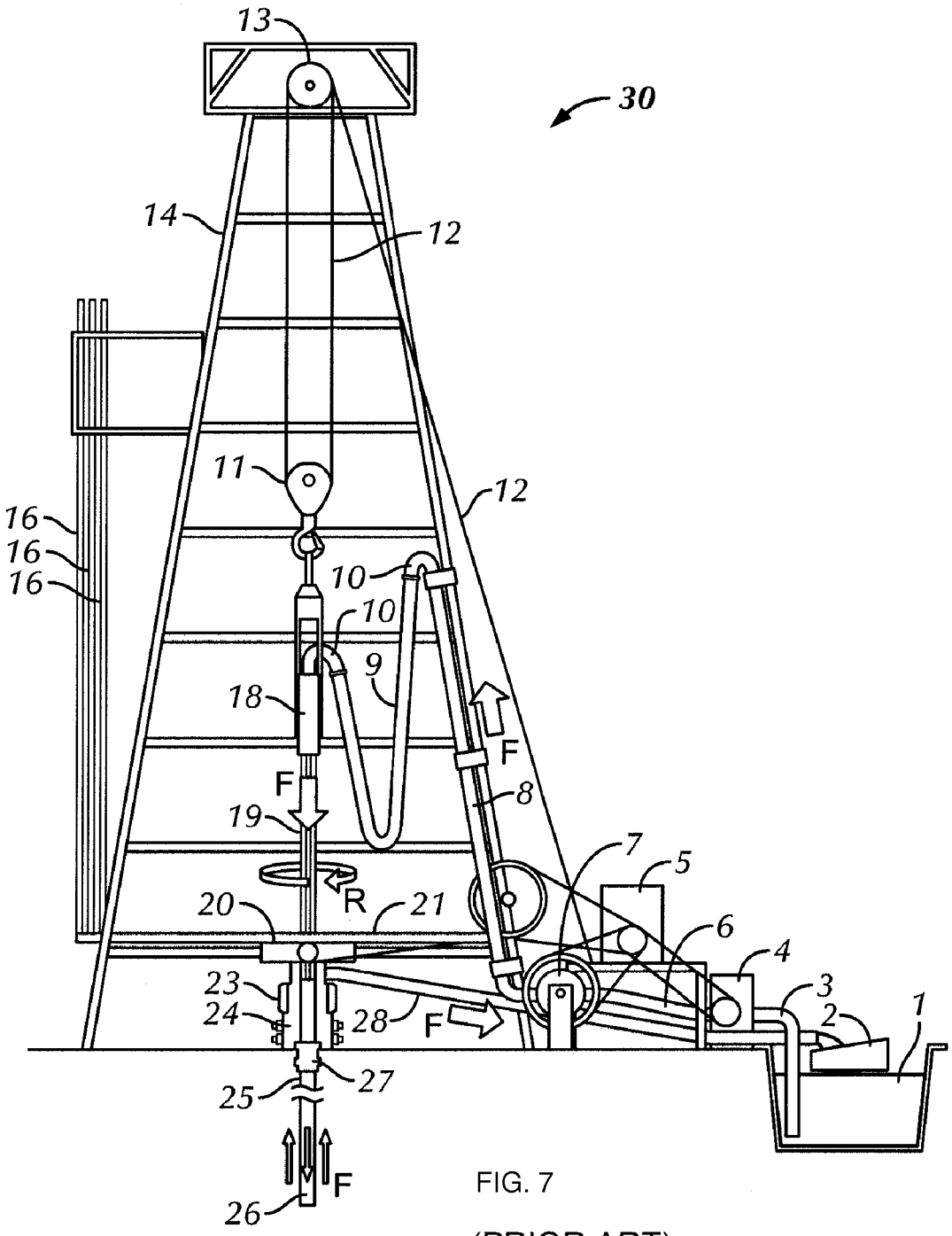
FIG. 7 (PRIOR ART)
FIG. 7 is a prior art drawing depicting a general drilling rig.

Referring now to FIGS. 1 to 4, a crown 100 of a drilling rig is illustrated in combination with the lighting system 200 of the present invention. Crown 100 includes a base 105 and an outer frame structure 110 including vertical 115 and horizontal 110 frame members arranged to extend from the base 105 such that the base 105 provides an internal floor to the crown 100. Various drilling rig functional elements are illustrated, as previously described with respect to FIG. 7, but these are not described herein in additional detail. The invention is not limited to particular types of drilling rig functional elements and may be used in various drilling rig applications. The crown 100 as herein illustrated and described is an exemplary crown intended to show those features and elements interacting with the lighting system 200. The lighting system in combination with other crown arrangements as are known in the art are equally contemplated by the invention.

Lighting system 200 generally includes a lighting frame 205 (shown in FIG. 6, and described in more detail herein below), a plurality of light support posts 210 arranged around a perimeter of the lighting frame and extending vertically such that one or more light fixtures 215, 215*a* and 215*b* may be connected to each light support post 210. The plurality of light fixtures 215 arranged and separated vertically from each other by their positioning on the light support posts 210 permits for light to be directed in a predetermined region proximate the crown 100 and at a predetermined region encompassing a ground area surrounding the drill rig. That is, one group of lights may be directed towards particular equipment on the drilling rig, while another group may be directed to an area surrounding the drilling rig to provide maximum lighting for personnel working in or around the drilling rig.

Figure 6:
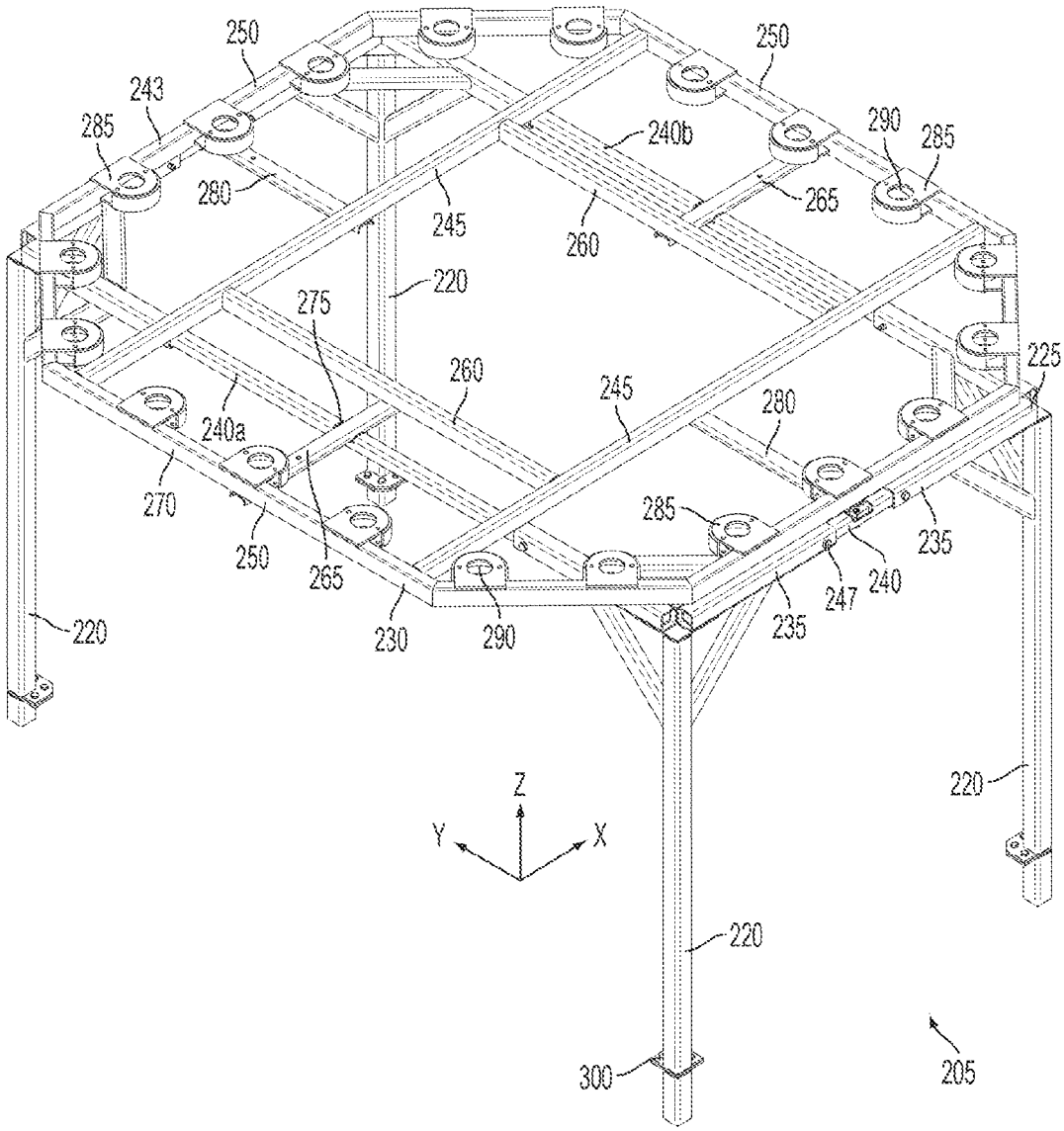
FIG. 6 is a perspective view of an exemplary lighting frame according to an embodiment of the invention.

Referring also to FIG. 6, there is shown an exemplary lighting frame 205 includes four corner support posts 220 extending from the base of the crown, or from a position proximate the base of the crown. The corner support posts 220 prop up, or otherwise raise above the base of the crown an adjustable frame portion 225. The adjustable frame portion 225 supports a light bearing frame portion 230, which will be described in further detail below. Adjustable frame portion 225 is provided such that the lighting system can be employed on crowns of various sizes. Providing the adjustable frame portion 225 in a manner independent of the light bearing frame portion 230 permits adjustment of the lighting frame 205 to fit various sized crowns without having to adjust the attachment of the individual lights 215 or adjust the number of lights 215 being attached to the fixture. In this manner, the lighting system can be readily retrofitted to an existing crown for long term use, or moved from one crown to another where short term use is required.

More particularly, the adjustable frame portion 225, includes along each of its outer portions, a pair of load bearing members 235 rigidly connected to respective corner support posts 220. Each pair of load bearing members 235 has positioned therebetween an extendable frame member 240. Each of the load bearing members 235 are tubular, such as tubular steel, and are positioned and otherwise arranged such that the extendable frame member 240 extends into the tubular portion of each pair of load bearing members 235. A pin or other protruding element 247 is arranged on the load bearing members 235 and is adapted to extend through a hole in the extendable frame member 240 to thereby fix the positioning of the load bearing members 235 with respect to the extendable frame member. In operation, the load bearing members 235 are slidable along the extendable frame member 240 to a desired point, where they can be locked in place by extending the pin 247 through the hole in the extendable frame member 240, and though a rear portion of the load bearing member 235 to lock the load bearing member 235 with respect to the extendable frame member 240. This permits the lighting frame 205 to be linearly adjustable in a rectangular manner along the x and y axis shown in FIG. 6. For completeness and clarity, it will be apparent that the frame 205 includes four pairs of the load bearing members 235 described above, adjustable about four respective extendable frame members 240. Extendable frame members 240*a* and 240*b* located on the longer sides of the frame 205 include a recess 275 proximate a midpoint thereof, the purpose of which will be described further below. Optionally, a similar recess may be provided in each of the extendable frame members 240.

The light bearing frame portion 230 is positioned atop the load bearing members 235 which provide support for the light bearing frame portion 230. The light bearing frame portion 230 includes an outer structural frame 243 consisting of a plurality of tubular or solid beams 250 forming a perimeter around which the series of lights are to be mounted. The bearing frame portion 243 further includes cross-braces 245 holding the structure together, where such cross-braces 245 are preferably perpendicular to a side of the lighting system having a longer length, for example perpendicular to the y axis shown in FIG. 6. Connecting the pair of cross-braces 245 are one, and preferably two support braces 260. The support braces 260 are positioned internally to the outer structural frame 230 and each have at a midpoint thereof a locating brace 265 connecting the support brace 260 to one member 270 of said outer structural frame 230.

In order to locate the light bearing frame portion 230 with respect to the adjustable frame portion 225, a recess 275 is provided in the extendable frame members 240*a* and 240*b*, into which the locating braces 265 are positioned. Fixing braces 280 connect the outer structural frame members 245 to the extendable frame members 240 along the shorter side of the frame, that is along the x axis of FIG. 6. With this arrangement, the adjustable frame portion 225 can be installed in a crown of varying sizes while the light bearing frame portion 230 is held centered upon the lighting frame, resulting in it being centered with respect to the crown on which it is placed. One skilled in the art will appreciate that various addition means for fixing the light bearing portion are also contemplated, including clamps, screws or additional locating pins.

Atop the light bearing frame portion 230, spaced along the perimeter of the tubular or solid beams 250 are a plurality of light holding platforms 285. The light holding platforms 285 are preferably welded, or otherwise attached, to the beams 250. The light holding platforms 285 generally comprise a portion attaching them to the beams 250 and a portion adapted to hold the light support posts 210, onto which each of the lights 215 are mounted. In the illustrated embodiment, the portion adapted to hold the light support posts 210 includes a recess or hole 290 into which the light support posts 210 can be friction-fit, clamped, screwed into, or otherwise attached. It is also contemplated that the light support posts 210 can be welded into the recess or hole 290.

Light support posts 210 preferably comprise a vertically extending post onto which a variety of styles of light fixtures 215 may be mounted. As discussed earlier, in a preferred embodiment two light fixtures may be mounted on each light support post 215, spaced vertically from each other, thus allowing light to be directed to a plurality of key positions around the drilling rig.

Figure 1:
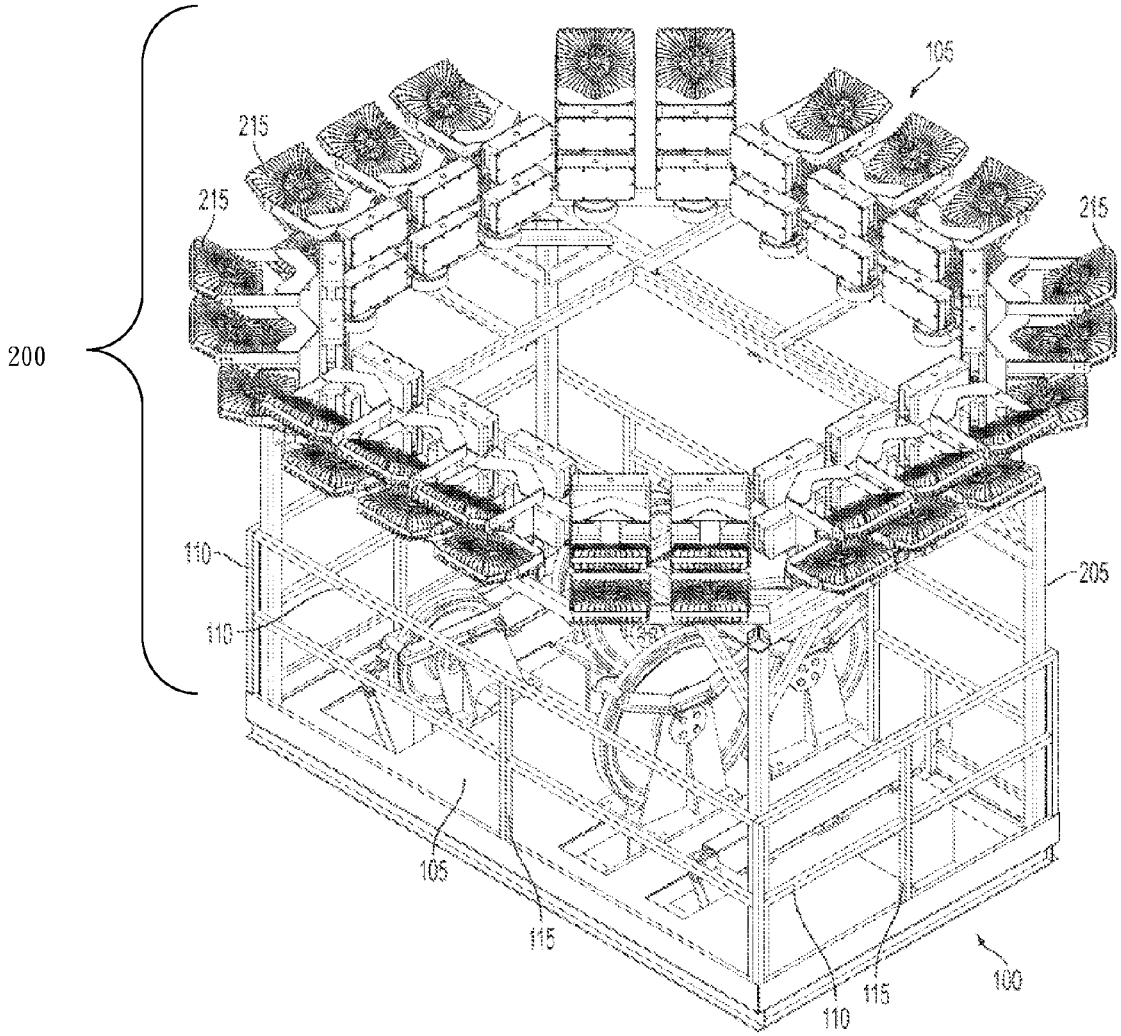
FIG. 1 is a perspective view of a lighting system mounted on a drilling rig according one embodiment of the invention.
Figure 2:
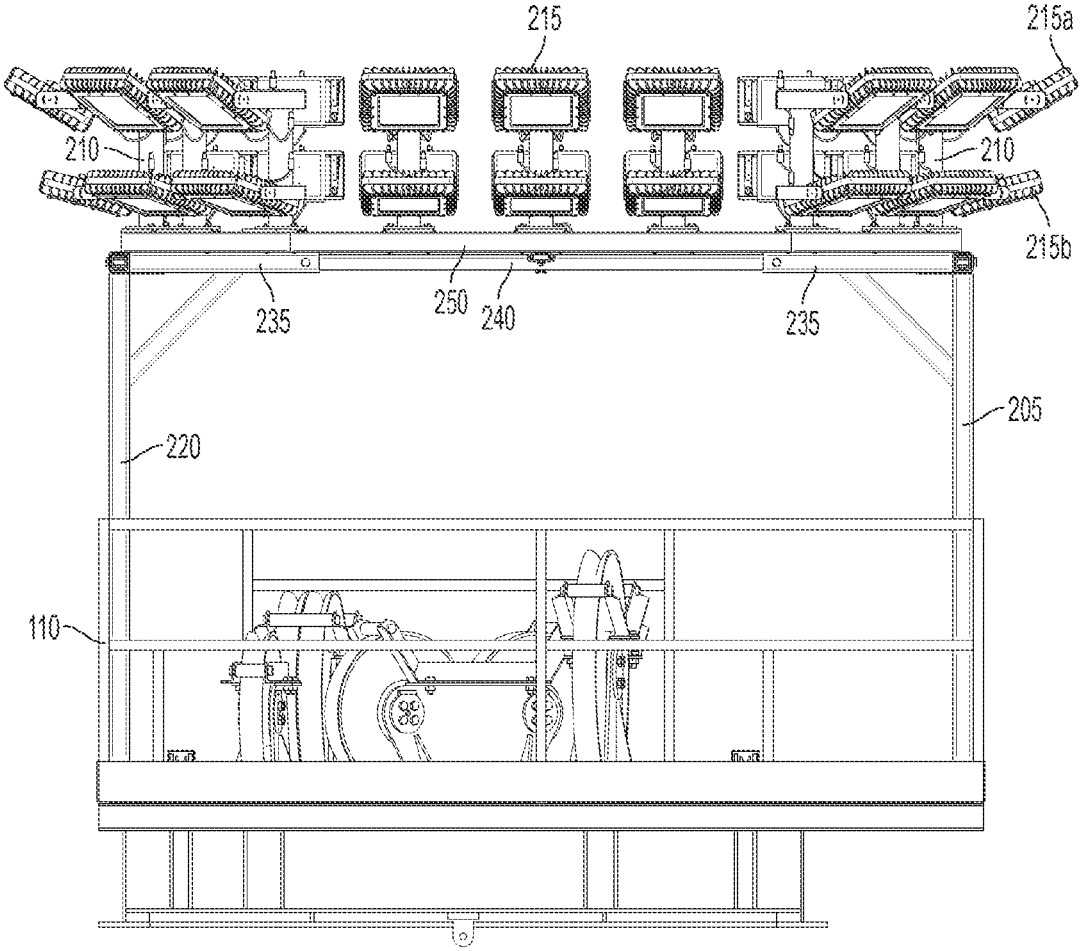
FIG. 2 is a front view of the embodiment of FIG. 1.
Figure 3:
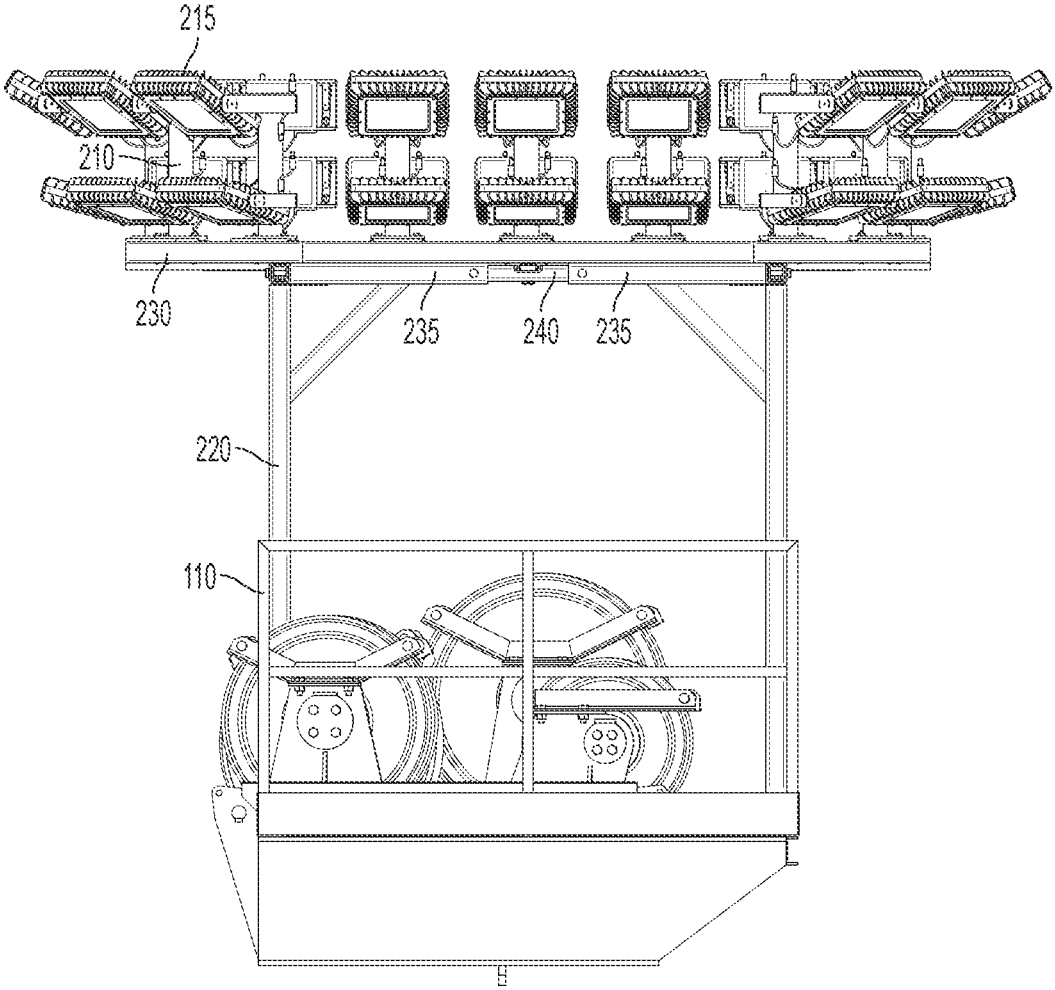
FIG. 3 is a side view of the embodiment of FIG. 1.
Figure 4:
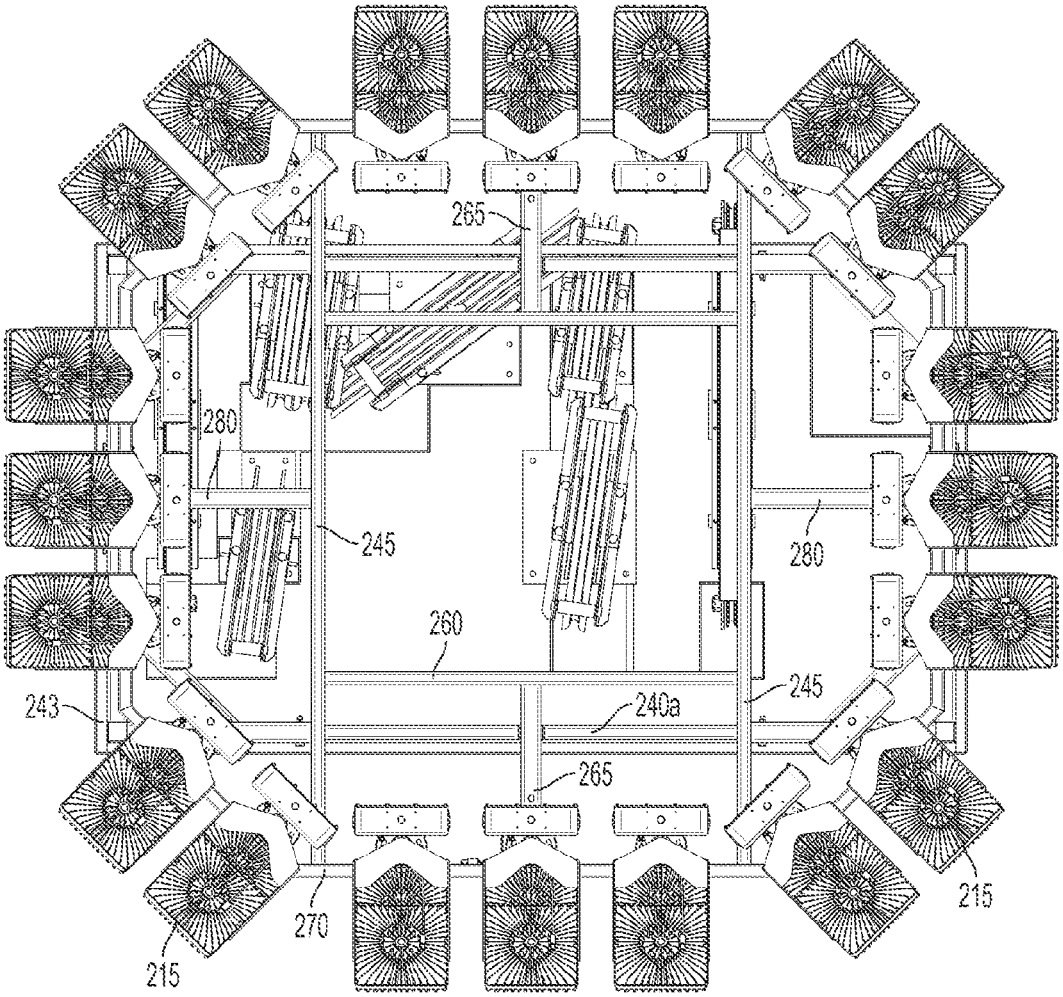
FIG. 4 is a top view of the embodiment of FIG. 1.
Figure 5:
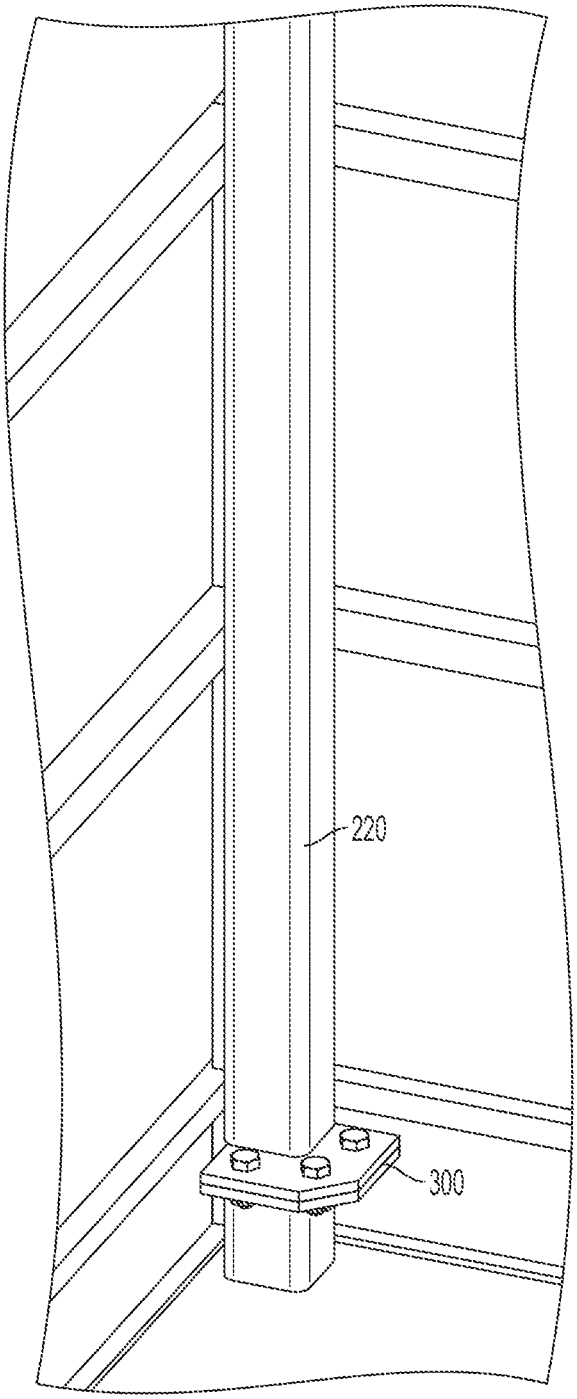
FIG. 5 is a detail perspective view of an example of how the lighting system may be connected to the drilling rig.

As shown in FIG. 5, in order to fix the lighting frame 205 with respect to the crown 100, brackets 300 may be provided proximate a bottom portion of each corner support post 220. The brackets 300 may be adapted to be connected to corresponding brackets (not shown) on the crown 100 or alternatively, to be attached directly to a portion of the crown itself. For example, bolts may fix the brackets 300 directly into a portion of the crown.

The scope of the claims should not be limited by the preferred embodiments set forth in description of the preferred embodiments or in the examples, but should be given the broadest interpretation consistent with the description as a whole.

The invention claimed is:

1. A lighting system particularly designed for attachment to the crown of a drilling rig comprising: a lighting frame attachable to the crown of the drilling rig, the lighting frame including an adjustable frame portion attachable to the crown of the drilling rig by support posts for rigidly fixing said adjustable frame portion to the crown, and a light bearing frame portion including support braces and cross braces, supported by and attached to said adjustable frame portion; multiple light support posts attached to said light bearing frame portion for holding multiple lighting fixtures; at least one lighting fixture attached to each of said light support posts said light bearing frame portion comprising an outer structural frame consisting of a plurality of connected beams forming a perimeter around which said lighting fixtures are attached; said light bearing frame portion further comprises a plurality of light holding platforms spaced around a perimeter of said outer structural frame; said light holding platforms each comprising a first portion for attaching to said outer structural frame and a second portion for holding said light support posts; the light bearing frame portion cross and support braces comprising at least two cross-braces connecting a first side of said outer structural frame to a second side of said outer structural frame; said first and second sides being generally parallel to each other; and at least one support brace connecting said at least two cross-braces to each other.

2. The lighting system according to claim 1, wherein said light bearing frame portion further comprises:

a locating brace connecting one of said at least one support brace to a third side of said outer structural frame; said third side being generally perpendicular to said first and second sides.

3. The lighting system according to claim 2, wherein said extendable frame member comprise a recess at a midpoint thereof sized and otherwise dimensioned to receive a main body portion of said locating brace, such that said recess restricts movement of said locating brace in a direction parallel to said extendable frame member.

4. The lighting system according to claim 3, wherein said extendable frame member comprises two of said extendable frame members positioned parallel to each other.

5. The lighting system according to claim 2, further comprising a second locating brace connecting a second of said at least one support brace to a fourth side of said outer structural frame; said fourth side being generally perpendicular to said first and second sides.

6. The lighting system according to claim 1, wherein said adjustable frame portion includes, between at least two of each adjacent support posts: a first tubular load bearing member connected to one of said adjacent support posts; a second tubular load bearing member connected to the other of said adjacent support posts; an extendable frame member extending between and into each of said first and second tubular members; such that said first and second tubular load bearing members are moveable with respect to said extendable frame member to thereby adjust a distance between adjacent support posts.

7. The lighting system according to claim 6, including a pin extendable through said respective tubular load bearing member and said extendable frame member to fix each of said first and second tubular members with respect to said extendable frame member.

8. The lighting system according to claim 2, wherein said support posts comprise at least four support posts and wherein said support posts are arranged to form a generally rectangular shape.

9. The lighting system according to claim 6, wherein said support posts are rigidly fixable to said crown by a bracket positioned proximate a bottom end of each said support posts; said bracket being attachable to a body of the crown, proximate a base of the crown.

10. The lighting system according to claim 1, wherein said each of said light support posts are adapted to hold at least two light fixtures.

11. The lighting system according to claim 10, where said at least two light fixtures are spaced vertically from each other.

12. The lighting system of claim 1 attached to the crown of a drilling rig.

* * * * *